US006478146B1

(12) United States Patent
Chapman

(10) Patent No.: US 6,478,146 B1
(45) Date of Patent: Nov. 12, 2002

(54) DISPLAY PACKAGING ASSEMBLY FOR SWIM MASKS AND GOGGLES HAVING CORRECTIVE LENSES

(76) Inventor: Michael M. Chapman, 631 Cliff Dr., Unit 1A, Laguna Beach, CA (US) 92651

( * ) Notice: Subject to any disclaimer, the term of this patent is extended or adjusted under 35 U.S.C. 154(b) by 0 days.

(21) Appl. No.: 09/888,703

(22) Filed: Jun. 23, 2001

(51) Int. Cl.[7] ..... B65D 85/38

(52) U.S. Cl. ..... 206/5; 206/316.1; 206/458; 206/471

(58) Field of Search ..... 206/5, 5.1, 6, 316.1, 206/316.3, 457, 458, 461, 471, 806

(56) References Cited

U.S. PATENT DOCUMENTS 4,453,629 A * 6/1984 Godberg ..... 206/457
4,485,921 A * 12/1984 Geller ..... 206/458
4,623,249 A * 11/1986 Grant ..... 206/5.1
4,653,642 A * 3/1987 Hakum et al. ..... 206/458
4,733,775 A * 3/1988 Fireman ..... 206/5
5,249,675 A * 10/1993 Strauss et al. ..... 206/5
5,337,888 A * 8/1994 Morrison ..... 206/5.1
5,464,094 A * 11/1995 La Haye ..... 206/5
5,878,443 A * 3/1999 Seiler ..... 206/5
6,003,672 A * 12/1999 Chapman et al. ..... 206/5
6,044,966 A * 4/2000 Haase ..... 206/5.1
6,345,716 B1 * 2/2002 Chapman ..... 206/458

* cited by examiner

*Primary Examiner*—Jim Foster
(74) *Attorney, Agent, or Firm*—Leonard Tachner

(57) ABSTRACT

A display packaging assembly for swim masks and goggles which have corrective lenses. In a first preferred embodiment for a mask and a second preferred embodiment for a pair of goggles, the product is contained in a transparent plastic shell and is located on a mannequin face or face portion in a configuration which simulates how the product would be worn by a swimmer. The opposing surfaces of the shell and the simulated eye portions of the mannequin are open at the lenses of the product. These openings permit a prospective purchaser to look through the corrective lenses without opening the package and without removing the product. Because the mannequin face or face portion is curved to provide a generally concave surface, the prospective purchaser may place the lenses of the mask or goggles in close proximity to his or her eyes without necessarily touching the package to the face and without touching any portion of the product itself.

14 Claims, 5 Drawing Sheets

DISPLAY PACKAGING ASSEMBLY FOR SWIM MASKS AND GOGGLES HAVING CORRECTIVE LENSES

BACKGROUND OF THE INVENTION

1. Field of the Invention

The present invention relates generally to a display packaging assembly for swimming and diving masks and goggles. The invention relates more particularly to such a packaging assembly wherein the masks and goggles have corrective lenses whereby a prospective purchaser may look through and evaluate the corrective lenses for his or her specific eye sight, but without removing the mask or goggles from the packaging assembly.

2. Background Art

Swimming and diving masks and goggles are designed to prevent water from contacting the eyes directly by forming a water-tight seal over the eyes. The seal creates an air gap which improves vision in and under the water and which also prevents discomfort to the eyes from constant contact with the water. Salt water, for example, can irritate and eventually cause burning and redness to the eyes. In recent years, such masks and goggles have been provided with corrective lenses for those who normally need to wear such lenses to have good vision. Given the large portion of the general population who need to wear corrective lenses including eyeglasses and contact lenses, it is fair to say that a substantial number of swimmers, snorkelers and divers were at a distinct disadvantage until the relatively recent implementation of corrective lenses in such masks and goggles.

One difficulty associated with the marketing of masks and goggles with corrective lenses, relates to the large range of optical correction that must be provided to meet the diverse needs of the buying public. One solution is to permit purchasers to obtain their corrective lenses after they obtain a mask or pair of goggles and then replace the original lenses with appropriate corrective lenses. However, this is a time-consuming and costly process and is substantially less convenient than enabling the purchaser to obtain proper lenses at the time of the purchase of the mask or goggles.

One way to overcome the inconvenience of special order corrective lenses obtained some time after purchase, is to offer corrective lens masks and goggles having a variety of different degrees of correction and then to permit the prospective purchaser to try on a number of such masks or goggles until he or she finds the appropriate amount of correction for his or her vision. Even if not precise enough to provide perfect vision, a corrective lens that is within a few tenths of a diopter of the purchaser's corrective glasses or contacts, can provide adequate vision for diving or snorkeling.

While corrective lenses in swim masks and goggles need not be as precise in vision correction as a pair of eyeglasses or contact lenses which are worn all day, they should nevertheless provide sufficient correction to enable a diver, swimmer or snorkeler to have relatively good vision in the water.

Unfortunately, in order to provide a prospective purchaser with an opportunity to try on various masks or goggles to select the best amount of correction available, conventionally packaged masks and goggles require opening of the package and removal of the product at the retail site. Such opening and removal are inherently inconvenient and disruptive and present a hygiene problem. Masks or goggles that have previously come in contact with the faces of prospective purchasers, could carry a variety of bacteria and raise concerns of prospective purchasers, as well as of retailers regarding potential liability.

Therefore, it would be highly advantageous if there were a display packaging assembly for swim masks and goggles having corrective lenses and which enabled prospective purchasers to try on and evaluate the lens correction at the retail site without removing the product from the packaging assembly. No prior art known to the applicant provides such a packaging assembly or any disclosure or suggestion of an assembly which would permit such in-store evaluation prior to purchase.

SUMMARY OF THE INVENTION

The present invention provides a display packaging assembly for swim masks and goggles which have corrective lenses. In a first preferred embodiment for a mask and a second preferred embodiment for a pair of goggles, the product is contained in a transparent plastic shell and is located on a mannequin face or face portion in a configuration which simulates how the product would be worn by a swimmer. More significantly, the opposing surfaces of the shell and the simulated eye portions of the mannequin are open at the lenses of the product. These openings permit a prospective purchaser to look through the corrective lenses without opening the package and without removing the product. Moreover, because the mannequin face or face portion is curved to provide a generally concave surface, the prospective purchaser may place the lenses of the mask or goggles in close proximity to his or her eyes without necessarily touching the package to the face and certainly without touching any portion of the product itself.

Thus, the invention provides a convenient non-disruptive and comparatively hygienic packaging assembly for masks and goggles with corrective lenses wherein a prospective purchaser may evaluate the corrective level of the lenses at the retail site and without opening the package or removing the product.

OBJECTS OF THE INVENTION

It is therefore a principal object of the present invention to provide a display packaging assembly for swim masks and goggles having corrective lenses, which assembly enables point of purchase lens evaluation without removing the product from the packaging.

It is another object of the invention to provide a display package for products having corrective lenses wherein the packaging is configured to provide unobscured vision through the lenses.

It is still another object of the invention to provide a display package for products having corrective lenses wherein the packaging provides enclosure of the entire product except the corrective lenses.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the following drawings in which.

DETAILED DESCRIPTION OF A PREFERRED EMBODIMENT

Figure 1:
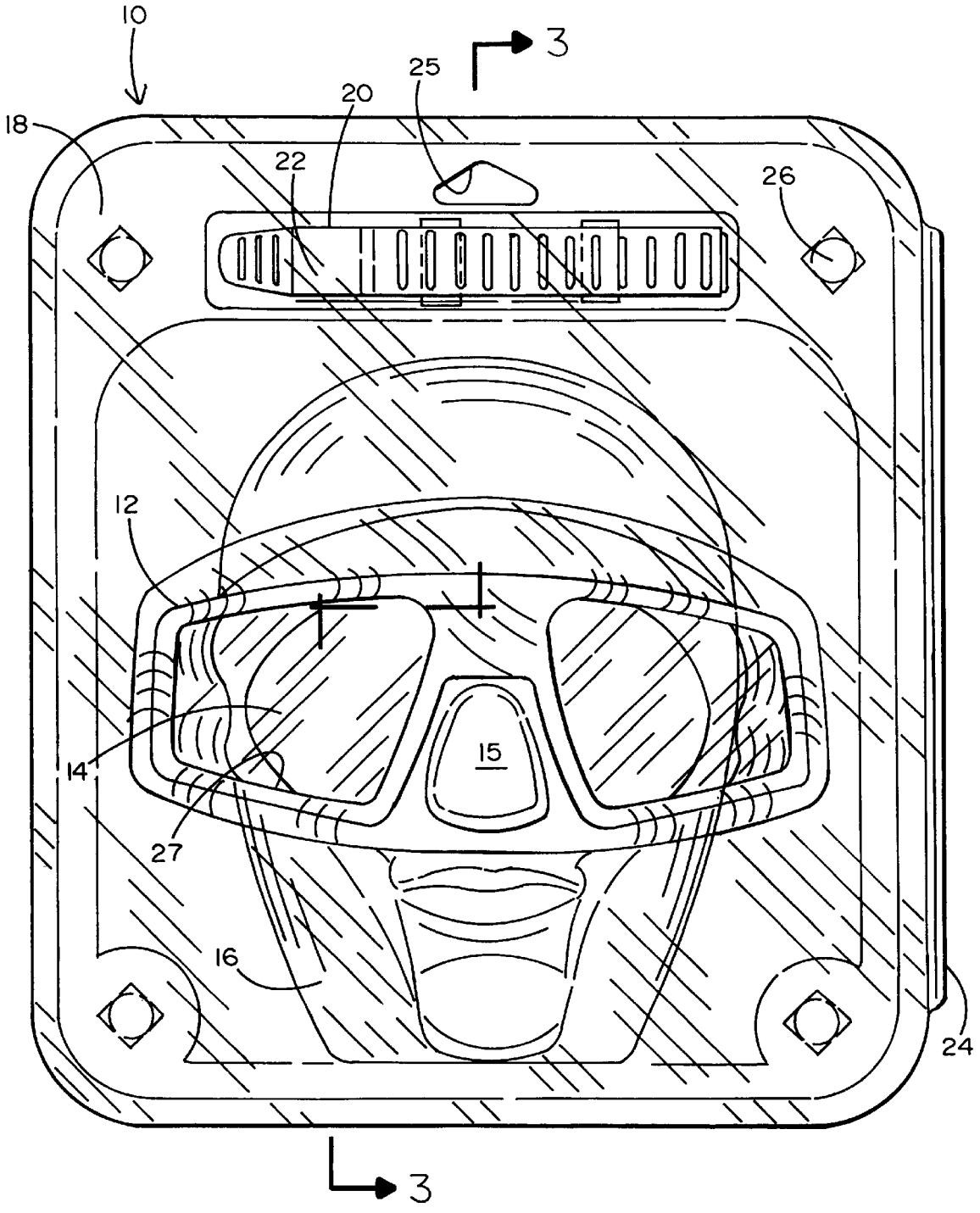
FIG. 1 is a front view of a preferred embodiment for packaging a mask.
Figure 2:
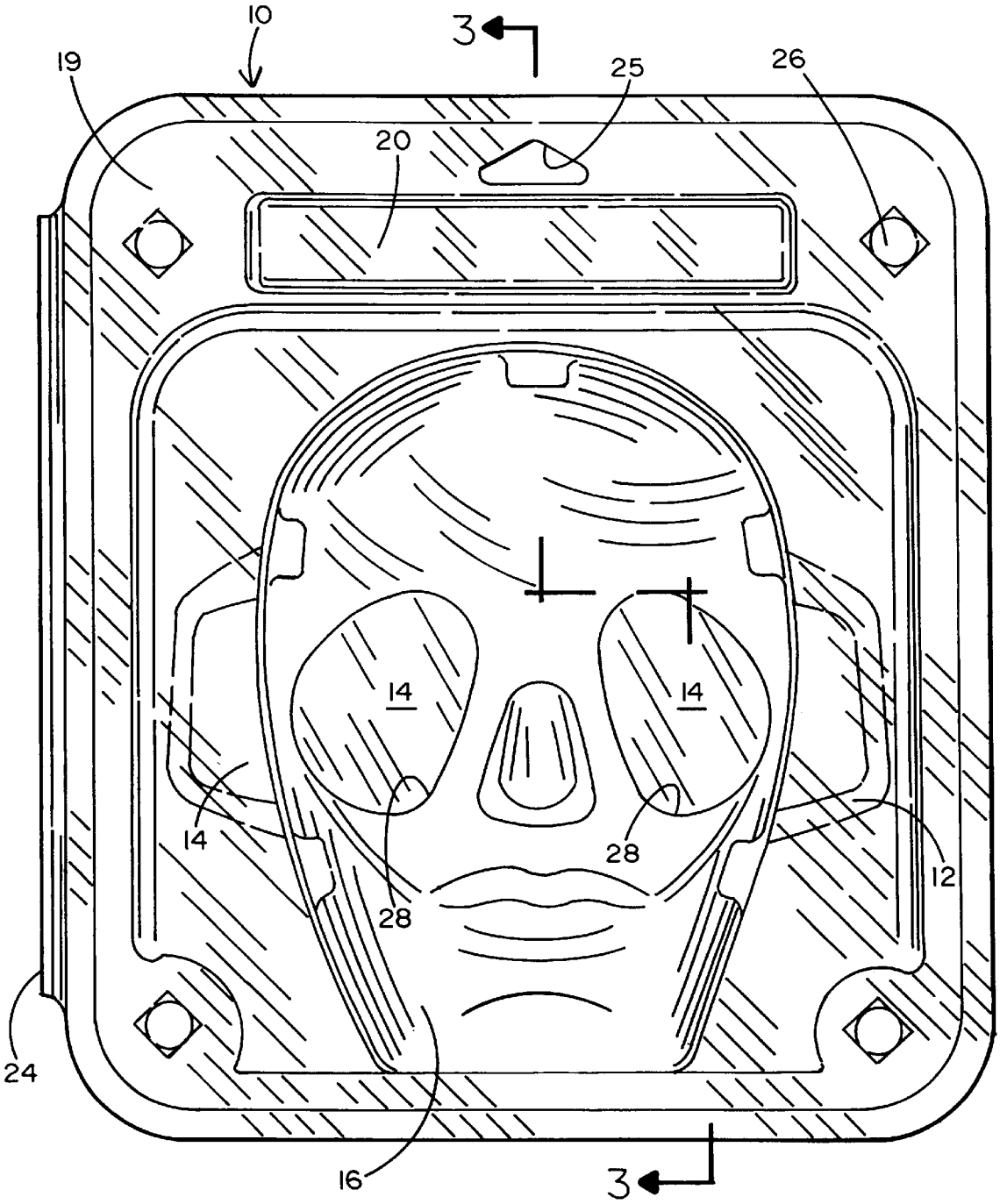
FIG. 2 is a rear view of the packaging of FIG. 1.

Referring to the accompanying drawings and initially to FIGS. 1–4, it will be seen that a first embodiment of a display packaging assembly 10 for swim masks is shown therein. The assembly 10 contains a mask 12 having a pair of corrective lenses 14. The mask is configured on a mannequin 16 simulating a human face from the chin to the forehead and having a nose portion 15.

The assembly 10 also comprises a transparent shell formed from a shell front 18 and a shell back 19. Front 18 and back 19 are connected at a hinge 24 and have a plurality of respective interconnecting members forming catches 26 to secure the front and back together in a releasable configuration. Shell front 18 comprises a pair of apertures 27 which may be generally congruent to the lenses 14. Similarly, shell back 19 and mannequin 16 have a common aperture 28 on each side of nose portion 15 to provide visual access through lenses 14. Shell back 19 also forms a generally rectangular compartment 20 enclosed by the overlying portion of shell front 18 and containing a strap 22 for connection to the mask 12 by the purchaser.

Figure 4:
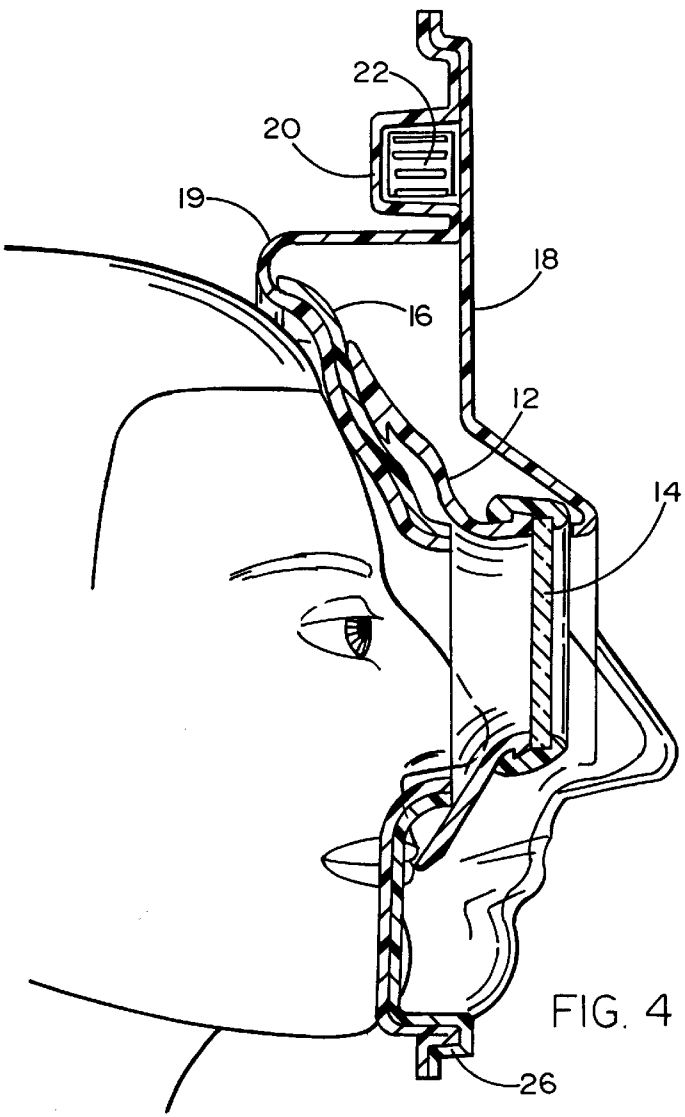
FIG. 4 is a view similar to that of FIG. 3 but illustrating how a prospective purchaser would evaluate the corrective lenses at a retail site.
Figure 3:
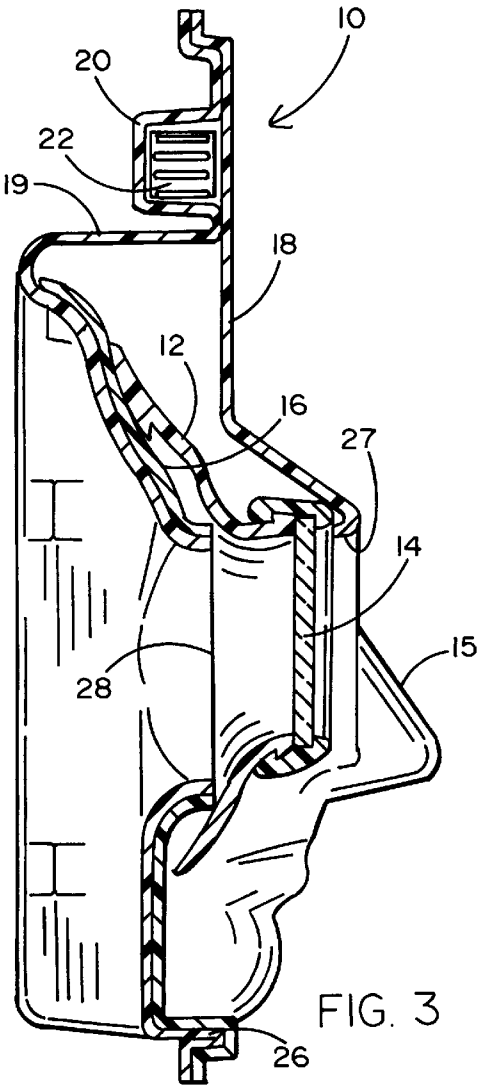
FIG. 3 is a cross-sectional view taken alone lines 3—3 in FIGS. 1 and 2.

As seen in FIGS. 3 and 4, the assembly 10 has a generally concave rear shape wherein the central region of shell back 19 is substantially congruent to the adjacent surface of mannequin 16. Consequently, a user may readily place the assembly in close proximity to his or her face as seen in FIG. 4. The user may thus align his or her eyes with the corrective lenses 14 and thereby quickly and conveniently evaluate the corrected vision through the mask 12 without removing the mask from the assembly and without disrupting the integrity of the assembly.

Figure 5:
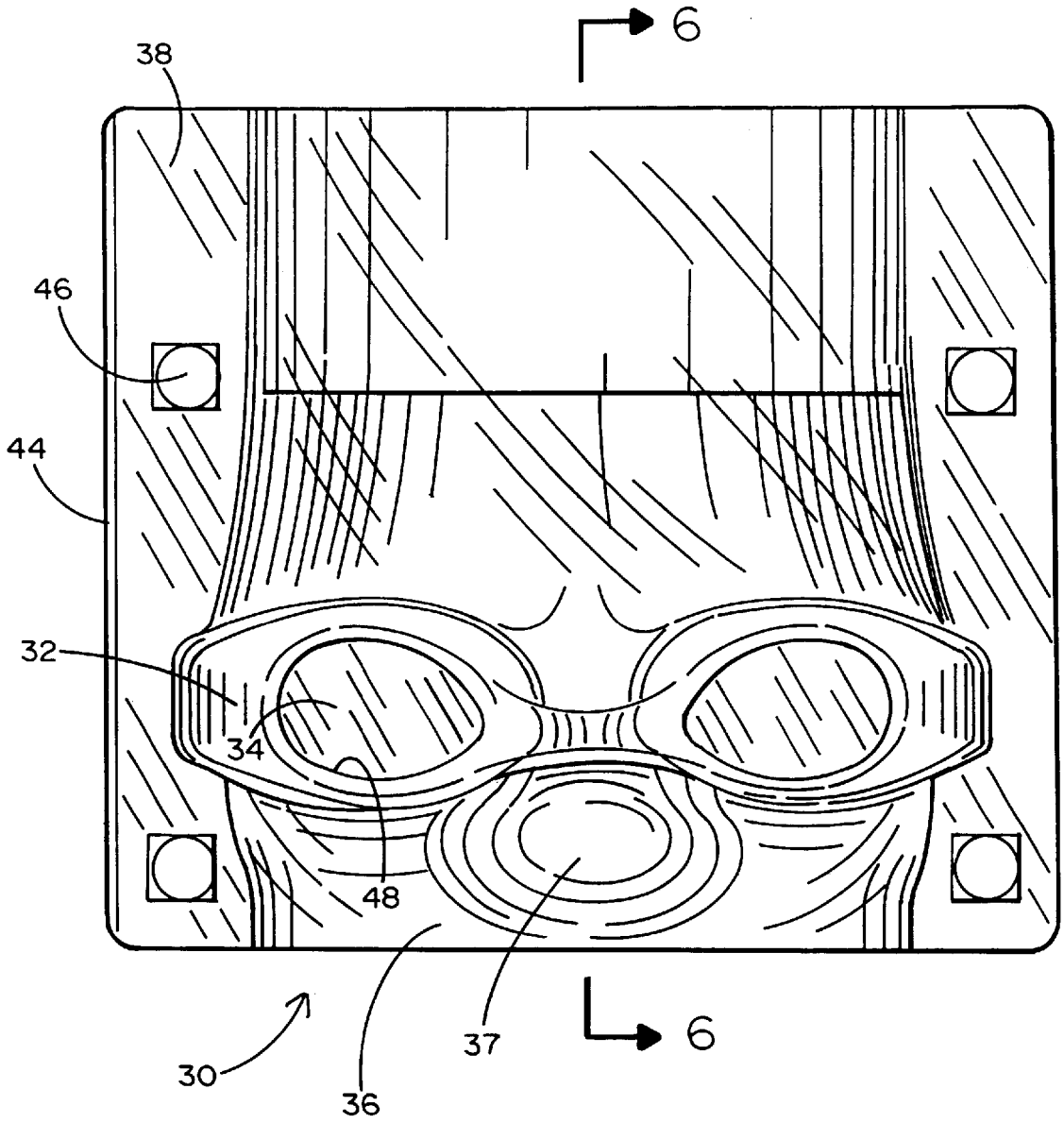
FIG. 5 is a front view of a preferred embodiment for packaging a pair of goggles.
Figure 6:
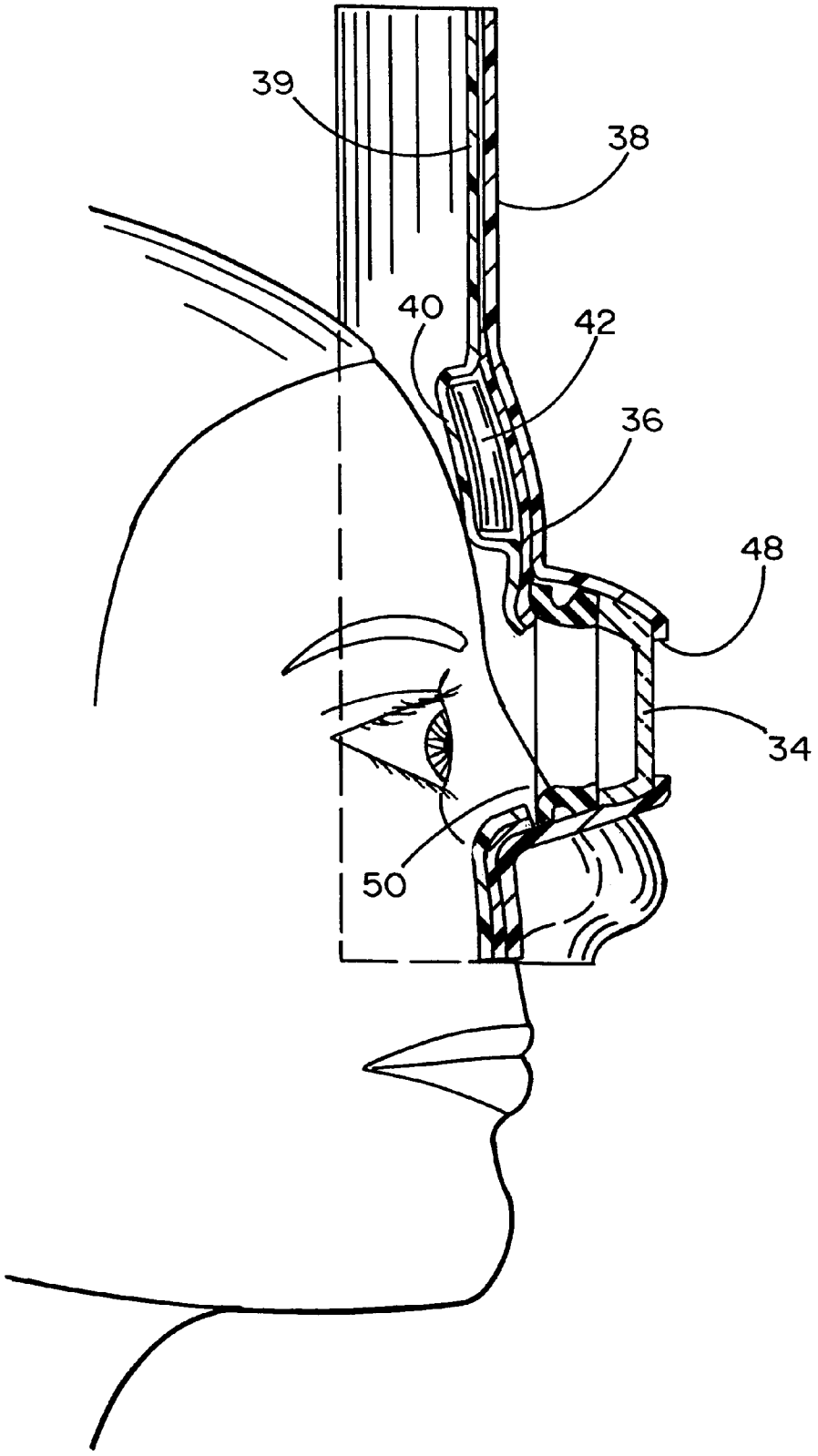
FIG. 6 is a cross-sectional view taken along lines 6—6 of FIG. 5 shown with a prospective purchaser in the manner of FIG. 4.

A similar configuration is shown in FIGS. 5 and 6 for a pair of swim goggles. More specifically, a goggle packaging assembly 30 for a pair of swim goggles 32 having corrective lenses 34 is illustrated. A transparent shell comprises a shell front 38 and a shell back 39 joined together at a common hinge 44 and having a plurality of catches 46. A compartment 40 holds a strap 42. Goggles 32 are mounted on a mannequin partial face portion 36 have a nose portion 37.

The corrective lenses 34 are aligned with an aperture 48 in shell front 38 and with a common aperture 50 in shell back 39 and mannequin 36. Thus, the embodiment shown in FIGS. 5 and 6 provides the same features and advantages of the embodiment of FIGS. 1 through 4, but configured for swim goggles instead. A prospective purchaser will, as illustrated in FIG. 6, be able to place unobstructed lenses 34 in close proximity to his or her eyes to evaluate the optical correction provided by the lenses. This can be accomplished without opening the assembly 30 and without removing the goggles 32 from the assembly.

Having thus disclosed illustrative embodiments of the invention, it being understood that numerous modifications and additions are contemplated and that the protection hereof is limited only by the scope of the appended claims and their equivalents, what I claim is:

1. A display packaging assembly for holding a product having corrective lenses; the assembly comprising:

a container having a front surface and a back surface for enclosing said product in a selected orientation;

each of said front and back surfaces having opposed apertures aligned with the corrective lenses of said product providing a line of sight through said lenses within said container.

2. The assembly recited in claim 1 further comprising a mannequin face portion trapped between said front and back surfaces for holding said product, said mannequin face portion having apertures aligned with said corrective lenses.

3. The assembly recited in claim 1 wherein said product is a pair of swim goggles.

4. The assembly recited in claim 1 wherein said product is a swim mask.

5. The assembly recited in claim 1 wherein said front and back surfaces are hingedly connected for selective opening of said container.

6. The assembly recited in claim 1 wherein said front and back surfaces are each transparent.

7. A display packaging assembly for holding a swim mask having corrective lenses; the assembly comprising:

a container having a front surface and a back surface for enclosing said swim mask in a selected orientation;

each of said front and back surfaces having opposed apertures aligned with the corrective lenses of said swim mask providing a line of sight through said lenses within said container.

8. The assembly recited in claim 7 further comprising a mannequin face portion trapped between said front and back surfaces for holding said product, said mannequin face portion having apertures aligned with said corrective lenses.

9. The assembly recited in claim 7 wherein said front and back surfaces are hingedly connected for selective opening of said container.

10. The assembly recited in claim 7 wherein said front and back surfaces are each transparent.

11. A display packaging assembly for holding swim goggles having corrective lenses; the assembly comprising:

a container having a front surface and a back surface for enclosing said swim goggles in a selected orientation;

each of said front and back surfaces having opposed apertures aligned with the corrective lenses of said swim goggles providing a line of sight through said lenses within said container.

12. The assembly recited in claim 11 further comprising a mannequin face portion trapped between said front and back surfaces for holding said product, said mannequin face portion having apertures aligned with said corrective lenses.

13. The assembly recited in claim 11 wherein said front and back surfaces are hingedly connected for selective opening of said container.

14. The assembly recited in claim 11 wherein said front and back surfaces are each transparent.

* * * * *